US006394838B1

(12) United States Patent
Yen

(10) Patent No.: US 6,394,838 B1
(45) Date of Patent: May 28, 2002

(54) INSERTION SOCKET FOR USE WITH A FLAT CABLE

(76) Inventor: Michael Yen, 3F, No. 18, Lane 87, Szu Yuan Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 09/777,584

(22) Filed: Feb. 5, 2001

(51) Int. Cl.[7] ..... H01R 9/07
(52) U.S. Cl. ..... 439/492; 439/495
(58) Field of Search ..... 439/492, 495, 439/260, 331, 73, 67, 496

(56) References Cited

U.S. PATENT DOCUMENTS 4,367,006 A * 1/1983 Rehbogen, Jr. et al. ..... 439/495
4,944,690 A * 7/1990 Imai ..... 439/492
6,056,572 A * 5/2000 Matsumoto et al. ..... 439/260
6,116,947 A * 9/2000 Takayasu ..... 439/495
6,203,345 B1 * 3/2001 Rogue et al. ..... 439/260
6,224,418 B1 * 5/2001 Miura et al. ..... 439/495

* cited by examiner

*Primary Examiner*—Hien Vu
(74) *Attorney, Agent, or Firm*—W. Wayne Liauh

(57) ABSTRACT

An insertion socket for flat cable includes a socket main body defining a plurality of terminal cavities therein, a cover pivotally connected to a top of the socket main body, and a plurality of terminals separately received in the terminal cavities. Each of the terminals has a rear end projected from a rear side of the socket main body to provide a connecting pin, and a front barb portion that is formed at a lower side with a plurality of backward extended barbs. When the cover is pivotally turned downward to close the socket main body, it contacts with and applies a pressure on the barb portions of the terminals to cause the barbs on the barb portions to contact with and press against a flat cable inserted into the insertion socket. And, a reactive force acted by the terminals on the closed cover does not result in a lifted cover.

2 Claims, 4 Drawing Sheets

INSERTION SOCKET FOR USE WITH A FLAT CABLE

BACKGROUND OF THE INVENTION

The present invention relates to an insertion socket for use with a flat cable, and more particularly to an insertion-type socket in which an increased contact pressure is applied by terminals provided inside the socket on the flat cable inserted into the socket when the cover of the insertion socket is closed onto the socket. With the insertion socket of the present invention, a large reactive force is generated by the terminals which acts on the cover so that the cover will not accidentally.

Soft flat cables are mainly used in integrated circuit boards to connect different circuits. On a circuit board 14, there is provided with a plurality of relatively small insertion sockets 12 for flat cables 10 to insert thereinto. As can be seen in FIG. 1, each of these insertion sockets 12 includes a cover 13. When the cover 13 is lifted to an open position, as shown by the phantom lines in FIG. 1, the insertion socket 12 has a widened front opening via which a flat cable 10 is inserted into the socket 12. When the cover 13 is in a close position on the insertion socket 12, the flat cable 10 is pressed to contact with terminals 11 received in the insertion socket 12 and thereby provides an electrical circuit. In brief, in the conventional insertion socket 12, the flat cable 10 is brought to contact with and press against the terminals 11 in the insertion socket 12 due to a pressure applied by the cover 13 on the flat cable 10 when the cover 13 is in the close position.

In the conventional insertion socket 12, a contact pressure applied on the flat cable 10 by the terminals 11 is calculated from the following formula (1):

$$CP=TP/TA \quad \ldots (1)$$

wherein CP is the contact pressure applied on the flat cable 10 by the terminals 11, TP is a total pressure against the flat cable 10 when the cover 13 is closed onto the insertion socket 12, and TA is a total area of the flat cable 10 contacting with and being pressed by the cover 13.

The total pressure is generated when the cover 13 is closed onto the insertion socket 12 and it is equal to a total resistance or reactive force from the flat cable 10 to or acted on the cover 13. In the event there is a total pressure or a total reactive force larger than a force retaining the cover 13 to the insertion socket 12, it will result in a loosened cover 13 from the insertion socket 12. That is, there is an upper limit in the value of the total pressure TP in the conventional insertion socket 12 shown in FIG. 1. This limitation prevents the flat cable 10 from being firmly connected to the insertion socket 12.

SUMMARY OF THE INVENTION

A primary object of the present invention is to provide an insertion socket that has a structure enabling an increase contact pressure applied by terminals received in the socket on a flat cable inserted into the socket, so that the flat cable would not easily separate from the insertion socket.

To achieve the above and other objects, the insertion socket for flat cable of the present invention mainly includes a socket main body defining a plurality of terminal cavities therein, a cover connected to a top of the socket main body to pivotally turn between an open and a close position, and a plurality of terminals separately received in the terminal cavities. Each of the terminals has a rear end projected from a rear side of the socket main body to provide a connecting pin, and a front barb portion that is formed at a lower side with a plurality of backward extended barbs. When the cover is pivotally turned downward to the close position on the socket main body, it contacts with and applies a pressure on the barb portions of the terminals to cause the barbs on the barb portions to contact with and press against a flat cable inserted into the socket main body and located below the barb portions. And, an area on each of the barb portions contacting with the cover in the close position is a specially determined bevel surface, such that a reactive force acted by the barb portions of the terminals on the cover in the close position on the socket main body does not result in a lifted cover.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 2:
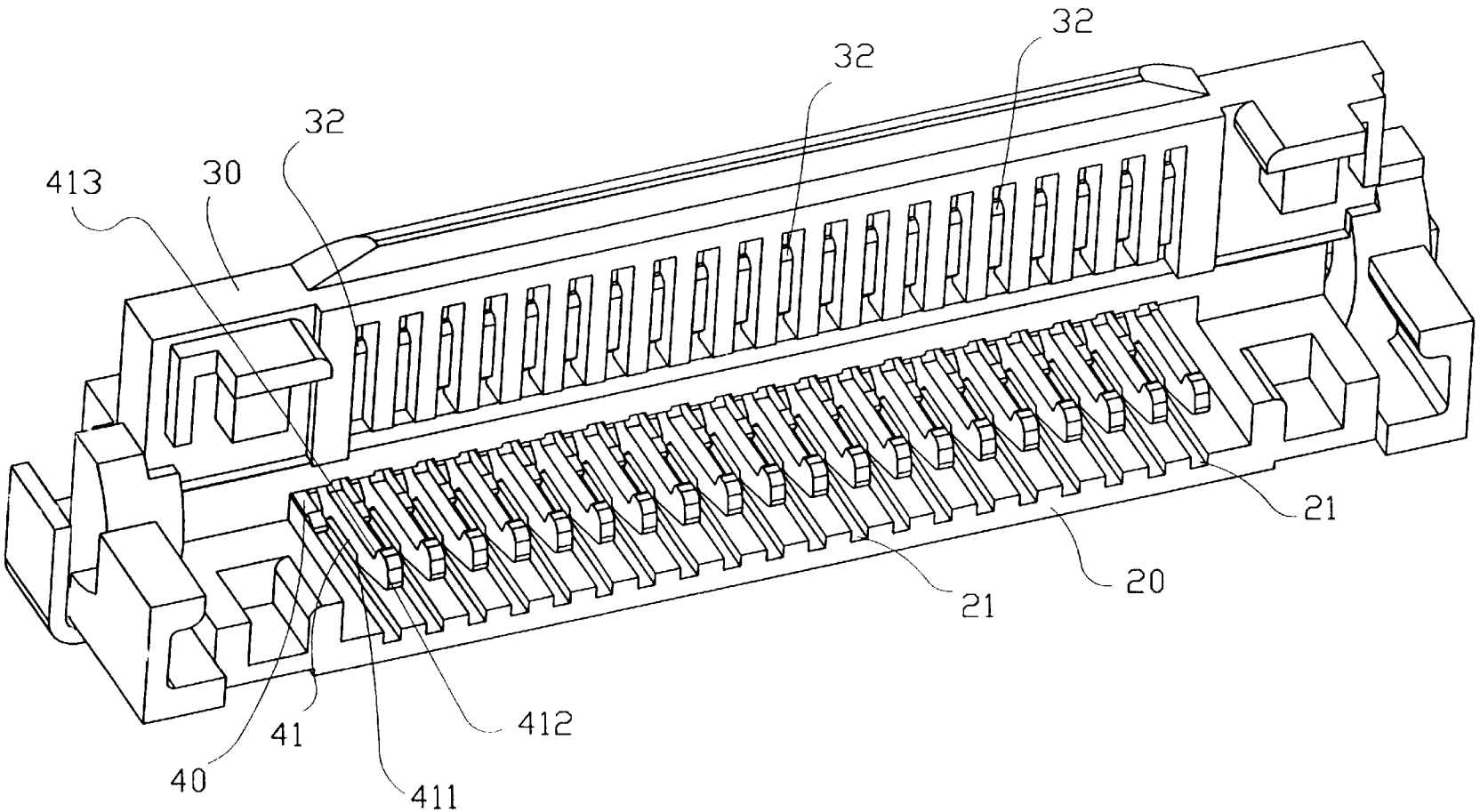
FIG. 2 is a perspective view of an insertion socket for flat cable according to an embodiment of the present invention.
Figure 4:
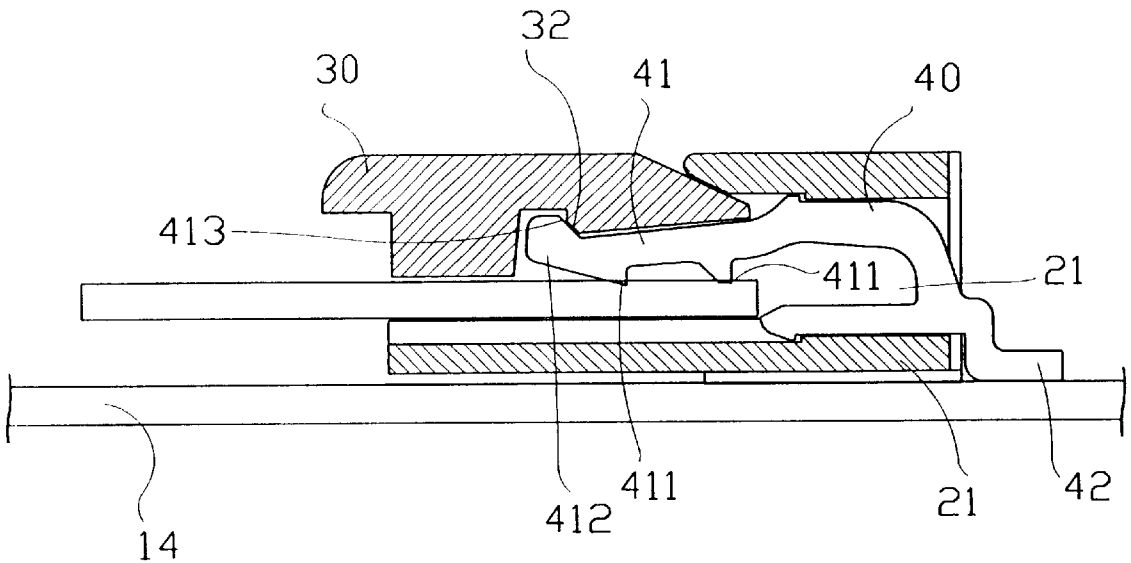
FIG. 4 shows the insertion socket for flat cable according to the present invention in use.
Figure 3:
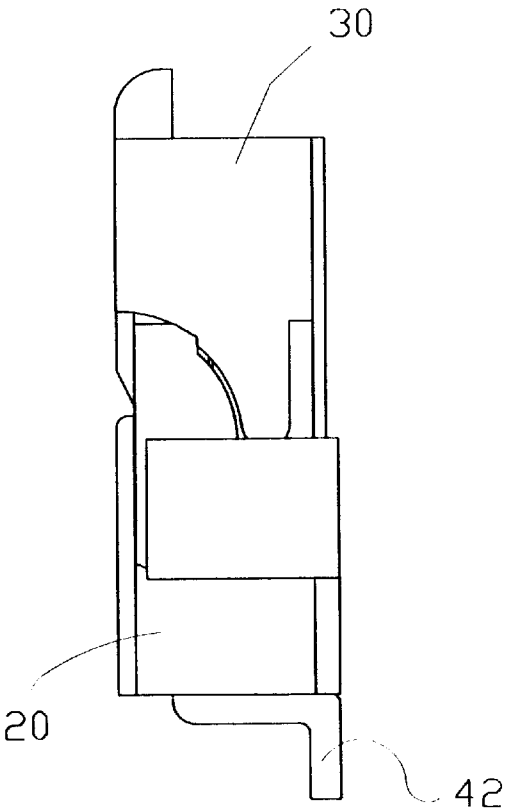
FIG. 3 is an end view of the insertion socket for flat cable according to the present invention.

Please refer to FIGS. 2, 3 and 4 in which an insertion socket according to an embodiment of the present invention is shown. The insertion socket is connected to a circuit board 14 and includes a socket main body 20 defining a plurality of terminal cavities 21 therein, a cover 30 connected to the socket main body 20 to pivotally turn between an open and a close position, and a plurality of terminals 40 separately received in the terminal cavities 21. Each of the terminals 40 has a rear end projected from a rear side of the socket main body 20 to provide a connecting pin 42, and a front barb portion 41 formed at a lower side with a plurality of backward extended barbs 411. When a flat cable 10 is inserted into the socket main body 20, it is located below the barb portions 41 of the terminals 40 to contact with the barbs 411. When the cover 30 is in the close position on the socket main body 20, it presses against the barb portions 41 of the terminals 40, causing the barbs 411 of the barb portions 41 to press against the flat cable 10 below the terminals 40.

Since the cover 30 is closed onto the socket main body 20 through a known structure that is not a feature of the present invention, no detailed description of the structure will be made herein.

In the present invention, a contact pressure applied on the flat cable 10 by the barbs 411 on the terminals 40 is calculated from the following formula (2):

$$CP'=TP'/TA' \quad \ldots (2)$$

wherein CP' is the contact pressure applied on the flat cable 10 by the barbs 411 on the terminals 40, TP' is a total pressure against the barb portions 41 of the terminals 40 when the cover 30 is in the close position on the socket main body 20, and TA' is a total area on the terminals 40 contacting with and being pressed by the cover 30 in the close position.

Figure 1:
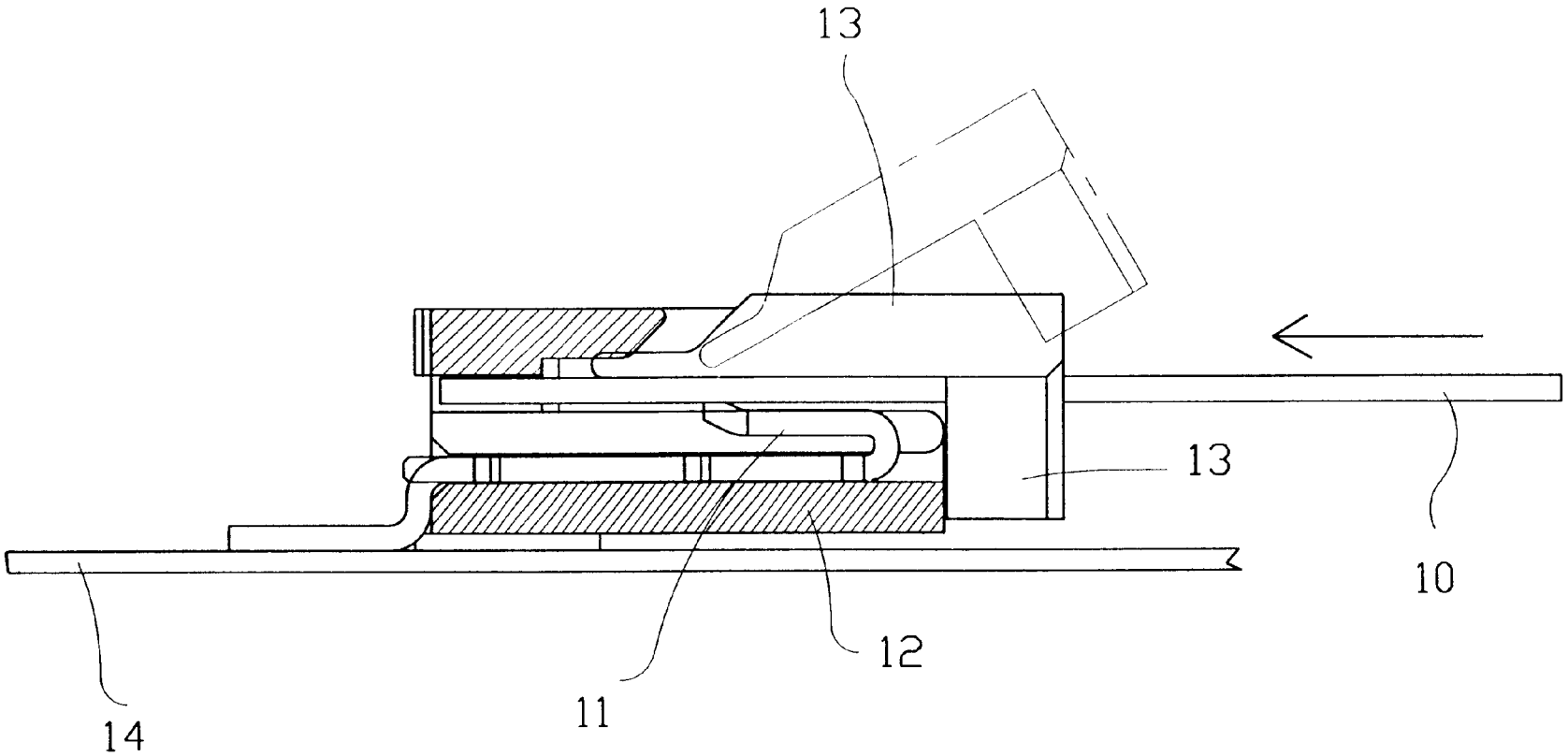
FIG. 1 is a partially sectioned side view of a conventional insertion socket for flat cable.

The total pressure TP' is originated from a force retaining the cover 30 to the close position on the socket main body 20. The force retaining the cover 30 to the socket main body 20, and accordingly the total pressure TP', is decided when the whole insertion socket is manufactured. Since the terminals 40 are separately received in the terminal cavities 21, the total contact area TA' between the barb portions 41 of the terminals 40 and the cover 30 is relatively small, compared with the total contact area TA between the flat cable 10 and the cover 12 as shown in FIG. 1. From the formula (2), the contact pressure CP' applied by the terminals 40 on the flat cable 10 is therefore relatively larger than the contact pressure CP. That is, the insertion socket of the present invention has a structure that provides higher contact pressure against the flat cable 10 from the terminals in the socket main body 20, so that the flat cable 10 inserted into the socket main body 20 would not easily separate from the insertion socket.

In particularly, the cover 30 contacts with the barb portions 41 of the terminals 40 at an upward extended head 412 of each barb portion 41. Moreover, an area 413 on each head 412 of the barb portion 41 contacting with the cover 30 is a bevel surface, and areas 32 on the cover 30 contacting with the heads 412 of the barb portions 41 are also bevel surfaces.

Figure 5:
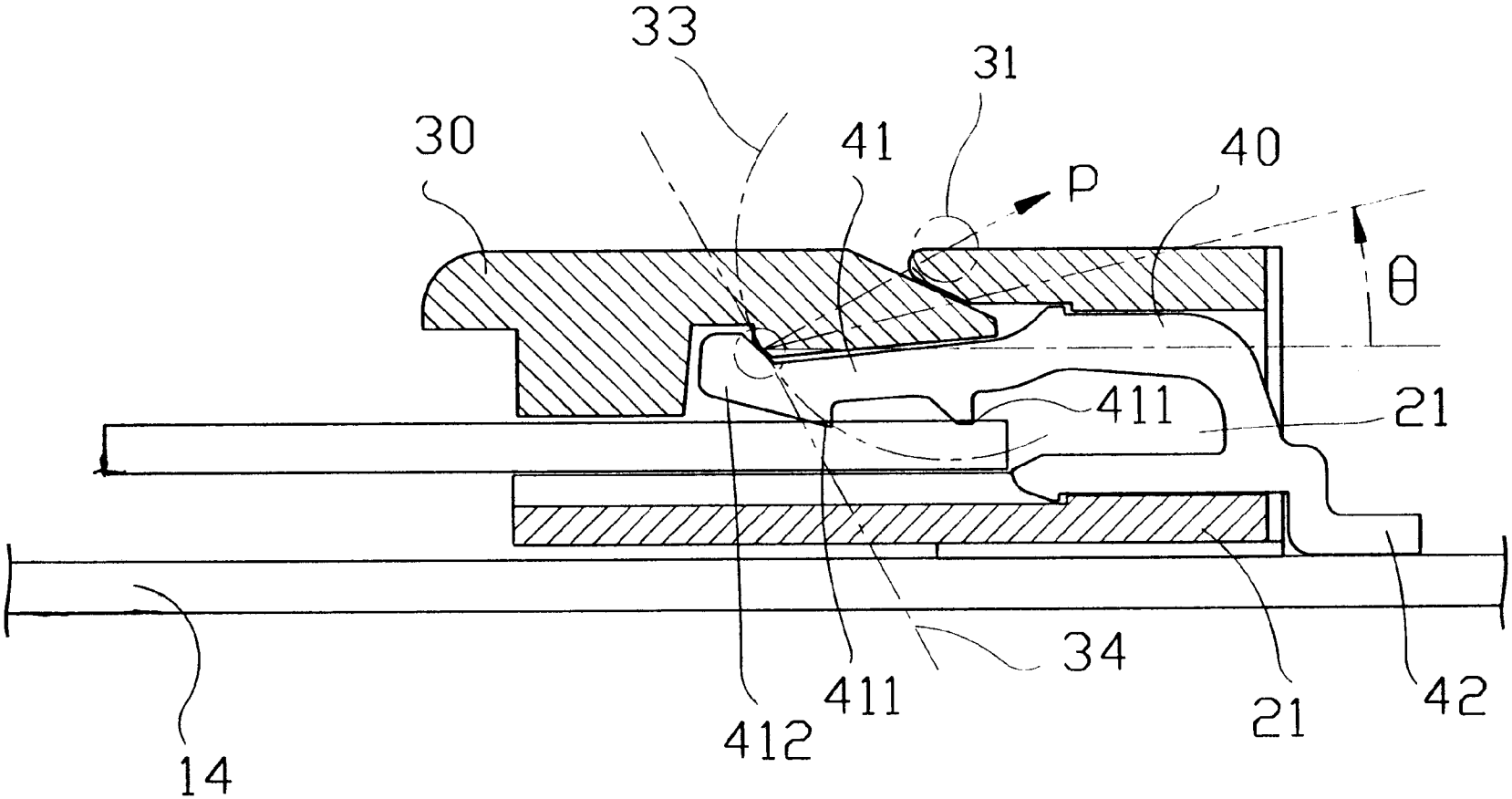
FIG. 5 explains how a reactive force is acted by terminals on the cover of the insertion socket of the present invention.

Please now refer to FIG. 5. When the cover 30 is in the close position on the socket main body 20, a reactive force acted on the cover 30 by the terminals 40 directs toward a pivot axis 31 of the cover 30. That is, the reactive force acted on the cover 30 when the latter is closed onto the insertion socket 20 and presses against the barb portions 41 of the terminals 40 does not form a force to lift the cover 30 to the open position.

As can be seen from FIG. 5, the bevel surface 413 on each of the heads 412 of the terminals 40 is determined by using the pivot axis 31 of the cover 30 as a center of circle to draw a circular arc 33 so that the latter is in contact with the head 412 at where the cover 30 contacts with and presses against the terminal 40, and then drawing a straight line 34 that is tangent to the circular arc 33. When a bevel surface 413 is in the same plane that contains and is in parallel with the tangent line 34, as viewed in FIG. 5, it will result in an optimum contact pressure CP'. With the optimum bevel surface 413 as determined in the above-described manner, a reactive force P acted on the cover 30 in the close position will direct toward the pivot axis 31 of the cover 30 without forming a force to lift the cover 30. In the event the insertion socket is otherwise designed so that a reactive force acted on the cover 30 has an angle θ smaller than an angle of the reactive force P that directs toward the pivot axis 31, the cover 30 could theoretically be more tightly closed onto the insertion socket 20. However, in an actual condition, the cover 30 will be stopped by an upper edge of the bevel surface 413 from being closed onto the socket main body 20.

For the cover 30 to be conveniently closed onto the socket main body 20 and in consideration of a possible elastic deformation of the barb portions 41 when they are under pressure from the cover 30, the insertion socket is usually so designed that an actual reactive force acted on the closed cover 30 has an angle slightly larger than the angle of the theoretically optimum reactive force P directing toward the pivot axis 31 of the cover 30, as in the embodiment shown in FIG. 4.

In conclusion, the insertion socket of the present invention includes a cover 30 and terminals 40 that are structured to provide an increased contact pressure on the flat cable 10 from the terminals 40. Moreover, the barb portions 41 of the terminals 40 are provided with bevel surfaces 413 that contact with the cover 30 in the close position without producing a reactive force to lift the cover 30 to the open position. Thus, the insertion socket of the present invention enables a firm connection of the flat cable 10 to it and therefore provides enhanced electrical performance.

What is claimed is:

1. An insertion socket for use with a flat cable, comprising:

a socket main body defining a plurality of terminal cavities therein, a cover connected to a top of said socket main body to pivotally turn between an open and a close position, and a plurality of terminals separately received in said terminal cavities;

each of said terminals having a rear end projecting from a rear side of said socket main body to provide a connecting pin, and a front barb portion having a plurality of backward extending barbs formed at a lower side of said front barb portion;

wherein said socket main body and said terminals are arranged in such a manner that when a flat cable inserted into said insertion socket, it will be located below said barb portions of said terminals, and that when said cover is pivotally turned to the close position of said socket main body, said cover contacts with and applies a pressure on said terminals at said barb portions to thereby cause said barbs on said barb portions to contact with and press against said flat cable;

further wherein said cover in said close position on said socket main body contacts with said terminals at an upward extended head of each of said barb portions, and an area on each of said heads of said barb portions in contact with said cover in said close position being a bevel surface, such that a reactive force acted by said terminals on said cover in said close position directs toward a pivot axis of said cover with an angle q1 contained between said reactive force and a horizontal surface.

2. An insertion socket for use with a flat cable as claimed in claim 1, wherein said reactive force acted by said terminals on said cover in said close position has an angle relative to a horizontal surface that is greater than said angle q1.

* * * * *